United States Patent [19]

Borggrefe et al.

[11] Patent Number: 4,735,735

[45] Date of Patent: Apr. 5, 1988

[54] SALTS OF ESTERS OF LONG-CHAIN FATTY ALCOHOLS WITH ALPHA-SULFOFATTY ACIDS AS CORROSION INHIBITORS IN OILS OR OIL EMULSIONS

[75] Inventors: Gerhard Borggrefe, Duesseldorf; Robert Piorr, Ratingen-Hoesel; Alfred Struve, Hilden, all of Fed. Rep. of Germany

[73] Assignee: Henkel Kommanditgesellschaft auf Aktien, Duesseldorf, Fed. Rep. of Germany

[21] Appl. No.: 53,445

[22] Filed: May 22, 1987

[30] Foreign Application Priority Data

May 24, 1986 [DE] Fed. Rep. of Germany ..... 3617550

[51] Int. Cl.[4] ..... C10M 129/70; C10M 129/66; C10M 129/95

[52] U.S. Cl. ..... 252/33; 252/33.6; 252/46.4; 252/39; 252/389.1; 252/389.52; 252/389.61

[58] Field of Search ..... 252/46.4, 389.1, 389.52, 252/33.6, 33, 389.61, 39

[56] References Cited

U.S. PATENT DOCUMENTS

| | | | |
|---|---|---|---|
| 2,342,027 | 2/1944 | Waugh | 252/389.52 |
| 2,679,526 | 5/1954 | DeGroote | 252/33 |
| 2,716,126 | 8/1955 | DeGroote | 252/33 |
| 2,858,272 | 10/1958 | Cook | 252/33 |
| 3,556,994 | 1/1971 | Diery et al. | 252/33.6 |

FOREIGN PATENT DOCUMENTS 1149843 6/1963 Fed. Rep. of Germany .

OTHER PUBLICATIONS

Ullmanns Enzyclopadie der Technischen Chemie, vol. 18, 4th ed. (1979), pp. 1–2.

Winnacker, Kuchler, "Chemische Technologie", vol. 4, 3rd ed. (1972), p. 475.

*Primary Examiner*—William R. Dixon, Jr.

*Assistant Examiner*—Jerry D. Johnson

*Attorney, Agent, or Firm*—Ernest G. Szoke; Henry E. Millson, Jr.; Mark A. Greenfield

[57] ABSTRACT

A method for corrosion inhibition in oil or oil emulsions comprising adding thereto a corrosion-inhibition-effective amount of at least one salt corresponding to the general formula

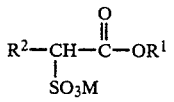

in which $R^1$ is a linear or branched $C_{8-36}$ alkyl or $C_{8-36}$ alkenyl or a mono- or polyethoxylated $C_{8-18}$ alkyl containing from 1 to 10 ethoxy groups, $R^2$ is a linear or branched $C_{10-20}$ *alkyl and*

M is half an equivalent of a divalent metal which is magnesium, calcium, barium, or zinc.

20 Claims, No Drawings

SALTS OF ESTERS OF LONG-CHAIN FATTY ALCOHOLS WITH ALPHA-SULFOFATTY ACIDS AS CORROSION INHIBITORS IN OILS OR OIL EMULSIONS

BACKGROUND OF THE INVENTION

1. Field of the Invention

This invention relates to the use of salts of esters of long-chain fatty alcohols with alpha-sulfofatty acids as corrosion inhibitors.

2. Statement of Related Art

Industrial processes in which metal surfaces, particularly surfaces of iron and iron alloys, come into contact with oils or oil-containing aqueous emulsions under extreme temperature and pressure conditions are hampered by the problem of corrosion of the metal surfaces. Processes of the type in question include, for example, industrial cooling processes, processes for cleaning metal surfaces and processes for machining metal surfaces, such as drilling, cutting, rolling, etc. Although oils or oil-containing emulsions are used in these processes, the effect of water on the metal surface is still a problem. Moreover, the successive corrosion of the metal parts coming into contact with the oils or oil-containing liquids leads to a drastic reduction in the useful life of the associated fabricating machinery and to problems in the subsequent treatment of the metal surface, for example in the application of a corrosion-inhibiting surface layer by phosphating or lacquering.

Accordingly, it has long been known to add corrosion inhibitors to the oil-based liquids coming into contact with the metal surfaces. Numerous compounds and mixtures of various compounds may be used as corrosion inhibitors, both in predominantly oil-containing liquids and in pure oils.

German published patent application No. 11 49 843 describes semiamides of saturated or unsaturated dicarboxylic acids and salts thereof with aliphatic primary amines as additives for fuel oils and lubricating oils. Although additives such as these distinctly improved the prevention of corrosion, they show a very marked tendency towards foaming which is unacceptable in additives of this type.

Alkali or amine salts of sulfonamidocarboxylic acids used as corrosion inhibitors having a good lubricating effect with very little tendency towards foaming are described in U.S. Pat. No. 3,556,9943 and corresponding German published patent application 12 98 672. However, corrosion-inhibiting preparations containing these compounds are attended by the disadvantages that they can only be produced by elaborate processes and that because of their relatively high content of sulfonamide, they occassionally show toxic effects or are at least potentially toxic, thus necessitating continual toxicological tests and monitoring.

Synthetic petroleum sulfonates are known to inhibit corrosion in oil or oil-containing systems, cf. Ullmanns Enzyklopadie der Technischen Chemie, Vol. 18, 4th Edition (1979), pages 1 and 2; and Winnacker, Kuchler "Chemische Technologie", Vol. 4: "Organische Technologie II", 3rd Edition (1972), page 475. However, the disadvantage of this class of compounds is that they are not biodegradable. Therefore, they cannot be used in processes which inevitably involve contact with the environment, because the egression of corrosion-inhibiting preparations containing compounds such as these into waste waters or into the ground could result in almost inestimable ecological damage.

DESCRIPTION OF THE INVENTION

Other than in the operating examples, or where otherwise indicated, all numbers expressing quantities of ingredients or reaction conditions used herein are to be understood as modified in all instances by the term "about".

The present invention provides corrosion-inhibiting compounds for use in oil-containing systems which do not have any of the abovementioned disadvantages of the prior art. The compounds used according to the invention are not only inexpensively obtainable in large quantities from regeneratable sources, but they are also at least equivalent to known corrosion inhibitors in their corrosion-inhibiting effect. In addition, they are ecologically and toxicologically safer and, more especially, show better biodegradability than previously known compounds.

It has now been found that certain salts of esters of long-chain fatty alcohols with alpha-sulfofatty acids satisfy all the abovementioned requirements.

The present invention therefore relates to a method for corrosion inhibition in oils or oil-containing emulsions, comprising the use therein of a corrosion inhibitor effective amount of at least one salt corresponding to the following general formula

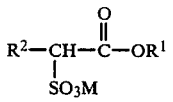

(III)

The above compound is an ester of at least one long-chain fatty alcohol corresponding to the following general formula

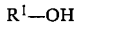

(I)

with at least one alpha-sulfofatty acid salt corresponding to the following general formula

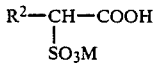

(II)

In the above formulae:

$R^1$ is a linear or branched $C_{8-36}$ alkyl, $C_{8-36}$ alkenyl or a mono- or poly-ethoxylated (1–10 E.O.) $C_{8-18}$ alkyl $R^2$ is a linear or branched $C_{10-20}$ alkyl, M is a half equivalent of a divalent metal which is magnesium, calcium, barium or zinc. Within the context of this invention, half an equivalent means that one of the foregoing metal atoms is capable of binding two monofunctional alpha-sulfofatty acid residues.

The salts (III) of esters of long-chain fatty alcohols with alphasulfofatty acids used in accordance with the invention are derived from at least one long-chain fatty alcohol corresponding to general formula (I), in which $R^1$ is a linear or branched $C_{8-36}$ alkyl or alkenyl. Although in general $R^1$ may be any radical described above, particular preference is given to those alcohols containing alkyl radicals $R^1$ which are inexpensively obtainable in large quantities from natural sources. Such alcohols are those in which $R^1$ is a linear alkyl, most preferably a $C_{8-22}$ linear alkyl. Suitable alcohols of this type are in the nalkanols, preferably octanol, nonanol, decanol, undecanol, dodecanol, tridecanol, tetradecanol, pentadecanol, hexadecanol, heptadecanol, octadecanol, nonadecanol, eicosanol, uneicosanol and/or docosanol. Alcohols such as these and particularly those representatives of this group which contain an even number of carbon atoms in the alkyl radical may be inexpensively obtained in large quantities on an industrial scale natural fats and oils via the corresponding fatty acids by known hydrogenation reactions of the carboxyl group. The ester salts used in accordance with the invention may not only be derived from the pure long-chain fatty alcohols corresponding to general formula (I), they may also be ester salt mixtures which are formed from mixtures of long-chain fatty alcohols (I) such as these accumulating in industrial manufacturing processes. Alcohol mixtures available from Henkel KGaA, Duesseldorf, F. R. of Germany under the trademark "Lorol'" may be regarded as mixtures such as these which contain ester salts of long-chain fatty alcohols corresponding to general formula (I) in which $R^1$ is a mixture of linear $C_{12-18}$ alkyls. Similarly, it is also possible with advantage to use corresponding ester salt mixtures of long-chain fatty alcohols (I) which are derived from mixtures of cetyl alcohol, (i.e. a saturated alcohol (I) with an unbranched $C_{16}$ alkyl), and oleyl alcohol, (i.e. an alcohol unsaturated in the 9,10-position containing an unbranched $C_{18}$ alkyl). Mixtures such as these are commercially obtainable from Henkel KGaA, Duesseldorf, F. R. of Germany under the trademark "Ocenol" with different proportions of the unsaturated oleyl radical, for example "Ocenol" 50/55 or "Ocenol" 92/96.

In addition, the ester salts used in accordance with the invention may be derived from long-chain fatty alcohols (I), in which $R^1$ is a branched alkyl. Alcohols containing branched alkyls such as these may be formed, for example, by subjecting alcohols of synthetic or natural origin to a "Guerbet" reaction from which 2-alkylalkan-1-ols are essentially obtained.

2-Ethylhexanol, 2-hexyldecanol and 2-hexadecyleicosanol are exemplary of useful branched alcohols. In addition, dimerized unsaturated fatty alcohols may also be used for the esterification. Dimerized oleyl alcohol (available under the trademark "Sovermol" from Henkel KGaA, Duesseldorf, F. R. of Germany) is one example of such an alcohol.

In addition, the ester salts used in accordance with the invention may also be derived from long-chain fatty alcohols corresponding to general formula (I) in which $R^1$ is a mono- or poly-ethoxylated alkyl. Alkyls such as these are $C_{8-18}$ alkyls with from 1 to 10 ethoxy moieties. It is emphasized in this connection that the number of ethoxy moieties per alkyl molecule (I) should be regarded as the average degree of ethoxylation of the particular alcohol and may vary over a more or less narrow range according to the production process.

In this case, too, preference is attributed to esters of long-chain fatty alcohols (I) having a $C_{12-18}$ alkyl and from 3 to 6 ethoxy moieties in the molecule.

The alpha-sulfofatty acid component of the ester salts used in accordance with the invention corresponds to the following general formula $$R^2-\underset{\underset{SO_3M}{|}}{CH}-COOH \qquad \text{(II)}$$

in which $R^2$ is at least one linear or branched $C_{10-20}$ alkyl and M is half an equivalent of at least one metal which is magnesium, calcium, barium or zinc. Accordingly, $R^2$ may be a linear alkyl selected from the group comprising decyl, undecyl, dodecyl, tridecyl, tetradecyl, pentadecyl, hexadecyl, heptadecyl, octadecyl, nonadecyl and eicosyl or even the corresponding branched isomers of the above alkyls. The alpha-sulfofatty acid component of the esters according to the invention preferably derives from fatty acids of natural origin which may be made accessible in large quantities by lipolysis from naturally occurring fats and oils. The resulting natural fatty acids are converted by hydrogenating hardening, if necessary, and subsequent sulfonation in known manner in the alpha-position to the carboxyl group, into the alpha-sulfofatty acids corresponding to general formula (II) which are one of the components for the ester salts of long-chain fatty alcohols with alpha-sulfofatty acids used in accordance with the invention. The fatty acid mixtures resulting from the lipolysis of natural fats and oils are preferably used for esters such as these. Preferred mixtures are those which contain $C_{12-18}$ fatty acids so that, for the alpha-sulfofatty acid component of the ester salts used in accordance with the invention, $R^2$ represents an even-numbered linear $C_{10-16}$ alkyl. Accordingly, adducts which lead to the alpha-sulfofatty acid components (II) of the ester salts (III) by the route indicated are lauric acid, myristic acid, palmitic acid, stearic acid, lauroleic acid, myristoleic acid, palmitoleic acid and oleic acid. Hydrogenation of unsaturated radicals $R^2$, subsequent sulfonation and reaction with bases of the formula $M_2(OH)_2$ or corresponding salts in alkaline medium gives the alpha-sulfofatty acid salts corresponding to general formula (II).

The process for producing the ester salts (III) of long-chain fatty alcohols with alpha-sulfofatty acid salts used as corrosion inhibitors in accordance with this invention resulting from this process are formed by reacting the fatty alcohols (I) with alpha-sulfofatty acids or salts thereof corresponding to general formula (II) in a suitable organic solvents, optionally in the presence of catalytic quantities of an acid; removing the solvent by known methods and, if desired, purifying and isolating the products by known methods. However, it is also possible to use the product solutions directly for inhibiting corrosion, i.e. without isolating the salts (III) in pure form.

Catalysts which have been successfully used for the process described above are, in particular, inorganic mineral acids such as hydrochloric acid, of which sulfuric acid is in general particularly preferred. However, acidic ion exchangers of other acidic catalysts known per se may also be used. The esterification reaction is normally carried out in an organic solvent, such as toluene or xylene. The reaction temperatures of the esterification reaction differ according to the alcohol (I) and alpha-sulfofatty acids or salts (II) used and are normally 0° to 140° C.

As in many other esterification reactions, it may be of advantage to remove the water formed during esterification by known methods. In the most simple case, this is done by means of an organic solvent suitable as an "entraining agent" which forms an azeotrope with water and, by so doing, removes it from the reaction mixtures. The equilibrium of the esterification reaction is thus successively displaced towards the products.

On completion of the reaction, which may be recognized by separation of the precalculated quantity of water, the organic solvent is removed by known methods, for example by distillation under normal or reduced pressure. If still necessary, the product mixture obtained is then converted into the salts (III) used in accordance with the invention, again by known methods (neutralization).

The esters or their salts (III) are obtained by the described process either as such or in the form of mixtures of different compounds when mixtures of compounds corresponding to general formula (II) have been used as the alpha-sulfofatty acid adduct and/or when fatty alcohol mixtures have been used as the fatty alcohol adduct (I).

However the ester salts of general formula (III) used in accordance with the invention are preferably produced from semisynthetic or synthetic fatty acid alkyl esters, preferably fatty acid methyl esters, with $SO_3$ in the alpha-position by known methods, adapting the sulfonation products to the usual quality standard again by known methods, for example by bleaching with hydrogen peroxide, and transesterifying the resulting fatty acid alkyl esters sulfonated in the alpha-position with addition of an excess of an alcohol $R^1$-OH (I), in which $R^1$ is as above defined. A major advantage of this procedure is that the successive reactions may be carried out without isolation of the intermediate products and that comparatively high product yields may be obtained, which leads directly -after neutralization in known manner- to the required ester salts of general formula (III) suitable for use in accordance with the invention.

Both the salts of the esters corresponding to general formula (III) and also mixtures of various such compounds are eminently suitable for use as corrosion inhibitors in oils and oil-containing emulsions. They are used with particular preference as corrosion inhibitors in lubricating oils, lubricating greases, transmission oils and machine oils based on mineral oils. The salts (III) used in accordance with the invention show excellent solubility in mineral oils and oil-containing emulsions and have the major advantage over known corrosion inhibitors, (such as petroleum sulfonates or comparable compounds), that they can readily be made in large quantities by wellknown and hence proven processes. In addition, they are considered completely safe in toxicological terms and degrade more easily than the petroleum sulfonates conventionally used as corrosion inhibitors.

Depending on the particular application, the salts (III) used in accordance with the invention are added in quantities of 0.05 to 10% (preferably 0.5 to 5%) by weight, based on the particular oil to be treated. Even at low concentrations, their corrosion-inhibiting effect is comparable with that of conventional inhibitors known from the prior art and, for in-use concentrations of the same order, is even better in some cases that the corosion-inhibiting effect of synthetic sulfonates, such as petroleum sulfonates.

The invention is illustrated by the following Examples.

EXAMPLE 1

Preparation of the esters according to the invention calcium salt of alpha-sulfonated $C_{12-18}$ fatty acid oleyl ester Fats used:

A. $C_{12-18}$ fatty acid methyl ester fraction from hardened palm kernel oil fatty acid methyl ester,
C-chain distribution: 48% $C_{12}$, 18% $C_{14}$, 10% $C_{16}$, 23% $C_{18}$
Saponification No.: 234,
Iodine No.: 0.1.

B. Oleyl alcohol by hydrogenation of enriched technical oleic acid methyl ester (commercially available for example under the trademark "Ocenol" 92/96).
Chain distribution:
$C_{16}$ saturated: 2.4%
$C_{18}$ saturated: 2.3%
$C_{20}$ saturated: 2.4%
$C_{16}$ monounsatruated: 1.7%
$C_{18}$ monounsatruated: 81.8%
$C_{20}$ monounsaturated: 1.1%
$C_{18}$ di- or tri-unsaturated: 7.0%
Hydroxyl No. 206
Iodine No. 95.

240 g (1 mol) of ester (A) were sulfonated with 72 g (0.9 mol) $SO_3$ by releasing the $SO_3$ present in 100 g 65% oleum (fuming sulfuric acid) and passing it as a gas in admixture with nitrogen (5% by vol. $SO_3$ to 95% by vol. $N_2$) through the ester (A) for about 1 h at a temperature of 80° C. The mixture was then left to react for 30 minutes at 80° C. The black sulfonation product was lightened by addition of 2% of 35% hydrogen peroxide.

410 g (1.5 mols) oleyl alcohol (B) were added to the bleached product. This was followed by heating with stirring for 4 h to 90° C. in a water jet vacuum. The methanol released (32 g) was condensed in a cold trap. The reaction product was found to have an acid number of 56.

For neutralization, the sulfonation product was added dropwise to 25.5 g calcium hydroxide in a mixture of 300 g water and 100 g isopropanol. The neutralized product (pH 5–8) separated with heating as the lighter phase containing the calcium salt together with a little isopropanol, unsulfonated ester and unused oleyl alcohol. This phase was separated off and freed from isopropanol and residues of water in vacuo at 90° C. The end product which solidified slowly at room temperature was found by analysis to contain 1.9% Ca.

EXAMPLES 2 to 4

Neutralization was carried out in the same way as in Example 1, but with magnesium hydroxide, barium hydroxide and zinc oxide instead of calcium hydroxide. Salts of alpha-sulfonated $C_{12-18}$ fatty acid oleyl ester with the following analytical data were obtained:
Magnesium salt (Example 2): 1.5% Mg
Barium salt (Example 2): 7.0% Ba
Zinc salt (Example 4): 3.7% Zn

EXAMPLES 5 to 7

The procedure in these Examples was the same as in Examples 1 to 4, except that sulfonation was carried out with 1.2 mols instead of 0.9 mol $SO_3$.

TABLE 1

| Example | Alcohol used for transesterification | Base used for neutralization | Analysis |
|---|---|---|---|
| 5 | 2-ethylhexanol | $Ca(OH)_2$ | 4.2% Ca |
| 6 | techn. lauryl alcohol[a] | ZnO | 4.9% Zn |
| 7 | tallow alcohol + 5 EO[b] | $Ca(OH)_2$ | 1.6% Ca |

[a]saturated alcohol from coconut oil fatty acid, $C_{12-18}$ fraction, hydroxyl number 271

[b]by ethoxylation of saturated tallow alcohol with 5 mols ethylene oxide, hydoxyl number 119.

EXAMPLE 8

Preparation of the pure barium salt of alpha-sulfo-$C_{12-18}$ fatty acid oleyl ester from the sodium salt by precipitation reaction (a) Preparation of the sodium salt The alpha-sulfo ester obtained as in Example 1 by sulfonation and transesterification with oleyl alcohol was neutralized with sodium hydroxide instead of calcium hydroxide. All unsulfonatable fractions were removed by extraction of the aqueous-isopropanolic solution with petroleum ether. The salt solution was then concentrated by evaporation in vacuo and dried. Ethyl acetate was added to the dry evaporation residue (500 g ethyl acetate to 20 g residue), followed by treatment for 10 minutes at reflux temperature. The solution was filtered and concentrated by evaporation. The evaporation residue (sodium salt) was found by analysis to contain 4.1% Na (calculated: 3.95% Na).

(b) Preparation of the barium salt 20 g (0.034 mol) of the sodium salt prepared in accordance with (a) was dissolved in water/isopropanol and an aqueous solution of 4.2 g (0.017 mol) $BaCl_2.2H_2O$ was added to the resulting solution. A crystalline deposit was formed and was filtered off. After drying in a high vacuum at 50° C., the resulting barium salt (17.2 g) of alpha-sulfo-$C_{12-18}$-fatty acid oleyl ester was found by analysis to contain 10.4% Ba (also 0.2% Na) (calculated: 10.9% Ba). This compound proved to be soluble in mineral oil.

EXAMPLE 9

Other ester salts of general formula (III) listed in Table 2 below were prepared in the same way as in Examples 1 to 8.

TABLE 2

| Ester salts corresponding to general formula (III) | | | |
|---|---|---|---|
| Example | Alcohol ($R^1$-OH) used for transesterification | $R^2$ | M |
| 9a | 2-ethylhexanol | $C_{10/16}H_{21/33}$ | ½ Ba |
| 9b | dodecanol | " | ½ Ca |
| 9c | lauryl alcohol, techn.[4+] | " | ½ Ca |
| 9d | lauryl alcohol, techn.[4+] | " | ½ Zn |
| 9e | oleyl-cetyl alcohol[1+] | " | ½ Ca |
| 9f | oleyl alcohol[2+] | " | ½ Ca |
| 9g | oleyl-cetyl alcohol[1+] | " | ½ Zn |
| 9h | oleyl alcohol[2+] | " | ½ Zn |
| 9i | oleyl alcohol[2+] | " | ½ Ba |
| 9k | oleyl alcohol[2+] | " | ½ Mg |
| 9l | dimeris. oleyl alcohol[3+] | " | ½ Ca |
| 9m | dimeris. oleyl alcohol[3+] | " | ½ Zn |
| 9n | $C_{32-36}$ Guerbet alcohol | " | ½ Ca |
| 9o | $C_{32-36}$ Guerbet alcohol | " | ½ Zn |

TABLE 2-continued

| Ester salts corresponding to general formula (III) | | | |
|---|---|---|---|
| Example | Alcohol ($R^1$-OH) used for transesterification | $R^2$ | M |
| 9p | Tallow alcohol + 5 E.O.[5+] | " | ½ Ca |

Remarks:

[1+]"Ocenol" 50/55 a trademark of Henkel KGaA, Duesseldorf, Germany

[2+]"Ocenol" 92/96 a trademark of Henkel KGaA, Duesseldorf, Germany

[3+]"Sovermol" a trademark of Henkel KGaA, Duesseldorf, Germany

[4+]"Lorol" a trademark of Henkel KGaA, Duesseldorf, Germany

[5+]E.O. = ethylene oxide

EXAMPLE 10

Steel bars (grade $C_k15$, surface degreased and cleaned with emery cloth) were stored for 24 h at 60° C. in stirred mixtures of mineral oil and artificial seawater in a ratio of 10:1 (method B according to DIN -German Industrial Norm- 51,585).

After the prescribed test period, the test specimens were examined for signs of corrosion. In this and the following Examples, corrosion was evaluated on the following scale:

0: no corrosion

1: traces of corrosion

2: slight corrosion (corroded area $\lesssim$5%)

3: moderate corrosion (corroded area between 5 and 20%)

4: serious corrosion (corroded area >20%) The results are shown below in Table 3.

COMPARISON EXAMPLE 1a

Following the same procedure as in Example 10, identical steel bars were stored for 24 h at 60° C. in mixtures of oil and seawater which did not contain an inhibitor. The results (Comp. 1a) are also shown below in Table 3.

COMPARISON EXAMPLE 1b

Following the same procedure as in Example 10, identical steel bars were stored for 24 h at 60° C. in mixtures of oil and seawater which contained a synthetic calcium petroleum sulfonate (Comp. 1b) as commercially available inhibitor. The results are shown below in Table 3.

TABLE 3

| Corrosion test according to DIN 51,585 (B) using the ester salts (III) Mineral oil: naphthenic | | | | |
|---|---|---|---|---|
| Compound of | Degree of corrosion for an inhibitor concentration of (%) | | | |
| Example 9 | 0.05 | 0.1 | 0.5 | 1.0 |
| a | 0 | 0 | 0 | 0 |
| b | 2 | 0 | 0 | 0 |
| c | 2 | 2 | 0 | 0 |
| f | 0 | 0 | 0 | — |
| g | 2 | 0 | 0 | — |
| h | 1 | 0 | 0 | — |
| i | 0 | 0 | 0 | — |
| k | 2 | 0 | 0 | — |
| l | 0 | 0 | 0 | — |
| m | 2 | 0 | 0 | — |
| o | 4 | 2 | 0 | — |
| p | 2 | 1 | 0 | — |
| Comp 1a | 4 | | | |
| Comp 1b | 1 | 1 | 1 | |

EXAMPLE 11

Humidity chamber test

In accordance with DIN 51,359, sand-blasted 25 mm by 50 mm steel plates of 088 St 1405 grade (degreased) were immersed in a naphtenic mineral oil containing ester salt (III) as corrosion inhibitors. After draining or drying for a certain time, the test specimens treated with the corrosion-inhibiting mineral oil were suspended in a humidity chamber and stored for 30 days in an atomosphere saturated with water vapor according to DIN 51,359, the relative air humidity being adjusted to 100% for a constant air supply of 875 1/h at a temperature of 50° C. After the prescribed test period, the test specimens were examined for signs of corrosion, the degree of corrosion being evaluated on the scale shown in Example 10.

The results are shown below in Table 4.

COMPARISON EXAMPLE 2a

In the same way as described in Example 11, steel plates of the same grade were immersed in a mineral oil which did not contain an inhibitor. The result is shown below in Table 4.

COMPARISON EXAMPLE 2b

In the same way as described in Example 11, steel plates of the same grade were immersed in a mineral oil which contained a synthetic calcium petroleum sulfonate as commercial inhibitor. The result is shown below in Table 4.

TABLE 4

| Corrosion test according to DIN 51,359 (humidity chamber) using the ester salts (III) (concentration 10%) | | | | |
|---|---|---|---|---|
| Compound of | Degree of corrosion after testing for | | | |
| Example 9 | 2d | 10d | 20d | 30d |
| a | 0 | 0 | 2 | 3 |
| b | 0 | 0 | 0 | 1 |
| c | 0 | 0 | 0 | 0 |
| d | 0 | 0 | 0 | 0 |
| e | 0 | 0 | 0 | 0 |
| f | 0 | 0 | 0 | 0 |
| g | 0 | 0 | 0 | 0 |
| h | 0 | 0 | 0 | 0 |
| i | 0 | 0 | 0 | 0 |
| k | 0 | 0 | 1 | 1 |
| l | 0 | 0 | 0 | 1 |
| m | 0 | 0 | 0 | 0 |
| n | 0 | 0 | 0 | 1 |
| o | 0 | 0 | 0 | 2 |
| Comp. 2a | 4 | | | |
| Comp. 2b | 1 | 1 | 1 | 1 |

EXAMPLE 12

Grey iron filings filter paper test

In accordance with DIN 51,360/Part 2, grey iron filings were wetted on a filter paper with a mineral oil-seawater emulsion according to DIN 51,360/Part 2 containing ester salts (III) in a concentration of 2% by weight as corrosion inhibitors. After a contact time of 2 h at room temperature, the traces of corrosion on the filter paper were visually assessed by the method described in the Standard.

The emulsions were prepared in the usual way from a concentrate of the following composition using water which had a total hardness of 3.5 mmols $CaCl_2 \cdot 6H_2O$ and $MgSO_4 \cdot 7H_2O$.

The concentrate which was introduced into water in quantities of from 4 to 8% by weight had the following composition:

60% naphthenic mineral oil,

15% emulsifier (adduct of 6.5 E.O. with nonylphenyl) and

25% of the ester sulfonate salt (III) used in accordance with the invention.

The results are shown below in Table 5.

COMPARISON EXAMPLE 3

In the same way as in Example 12, grey iron filings were wetted with a mineral oil emulsion which did not contain an inhibitor. The formulation used contained naphthenic mineral oil and emulsifier in a ratio by weight of 4:1.

The results are shown below in Table 5.

TABLE 5

| Corrosion test according to DIN 51,560/Part 2 using the ester salts (III) (concentration 2%) | |
|---|---|
| Compound of Example 9 | Degree of corrosion |
| f | 0 |
| g | 0 |
| h | 1 |
| i | 0 |
| l | 1 |
| m | 0 |
| n | 0 |
| o | 0 |
| Comp. 3 | 4 |

EXAMPLE 13

Weight loss test

ST 1405 steel plates which had been degreased and cleaned with emery cloth (dimensions 25 mm × 50 mm) were immersed in stirred mineral oil emulsions at 50° C. and exposed for 2 weeks to the action of a chloride-containing, hard-water emulsion while, at the same time, oxygen was bubbled through. Two plates were used for each inhibition test. At the end of the test period, the weight loss of both plates was gravimetrically determined and the values obtained were averaged.

By comparing the averaged values with the average weight losses obtained in a blank test using inhibitor-free emulsion, the corrosion inhibition in % could be calculated in accordance with the following equation:

$$In. = \frac{\Delta W_O - \Delta W_I}{\Delta W_O} \times 100\ (\%)$$

where $\Delta W_O$ is the weight difference of the test plate before and after storage in inhibitor-free emulsion and $\Delta W_I$ is the weight difference of the test plate before and after storage in inhibitor-containing emulsion.

The results are shown in Table 5 below.

COMPARISON EXAMPLE 4

In the same way as described in Example 13, steel plates were exposed to a mineral oil emulsion which did not contain an inhibitor. The ratio by weight of mineral oil to emulsifier in this emulsion was 4:1. The emulsifier used was an adduct of 6.5 E.O. with nonyl-phenol, while the oil used was a naphthenic mineral oil.

The results are shown below in Table 6.

TABLE 6

| Corrosion test (weight loss test) using the ester salts (III) | | | | |
|---|---|---|---|---|
| Compound of Example No. | Conc. inhibitor (%) | Weight loss (mg) | Weight loss ($g/m^2$) | Inhibition (%) |
| 9f | 0.01 | 10 | 4.0 | 99.4 |
| | 0.05 | 0.5 | 0.2 | 99.9 |
| 9i | 0.01 | 12.5 | 4.86 | 99.2 |
| Comp. 4 | 0 | 156 | 625 | 0 |

EXAMPLE 14

ST 1405 steel plates which had been degreased and cleaned with emery cloth (dimensions: 25 mm×50 mm) were immersed in mineral oil emulsions containing 20% by weight of the following concentrates:

60% naphthenic mineral oil,

15% emulsified (adduct of 6.5 E.O. with nonylphenol) and

25% ester sulfonate salt (III).

After draining and drying for a certain period, the test specimens were stored for 30 days at room temperature in a humidity chamber containing an atmosphere saturated with water vapor (100% relative air humidity). At the end of the test period, the steel plates were assessed for corrosion on the basis of the evaluation scale shown in Example 10.

The emulsions were prepared by standard methods from the corresponding concentrates (see above) using water having a total hardness of 3.58 mmols $CaCl_2.6H_2O$ and $MgSO_4.7H_2O$.

The results are shown below in Table 6.

COMPARISON EXAMPLE 5

Steel plates of the same grade as in Example 14 were treated in the same way as in that Example, except that the emulsions did not contain an inhibitor. The ratio of mineral oil to emulsifier in the comparison emulsions was 4:1.

The results are shown below in Table 7.

TABLE 7

| Corrosion test using the ester salts (III) | | | | |
|---|---|---|---|---|
| Compound of Example 9 | Degree of corrosion after 2d | 10d | 20d | 30d |
| e | 0 | 0 | 0 | 0 |
| f | 0 | 0 | 0 | 1 |
| g | 0 | 0 | 0 | 1 |
| h | 0 | 0 | 0 | 1 |
| i | 0 | 0 | 0 | 0 |
| k | 0 | 0 | 0 | 2 |
| l | 0 | 0 | 1 | 1 |
| m | 0 | 0 | 0 | 0 |
| n | 0 | 0 | 0 | 0 |
| o | 0 | 0 | 0 | 0 |
| Comp. 5 | 4 | (discontinued-unacceptable) | | |

We claim:

1. A method for corrosion inhibition comprising adding to an oil or oil-containing emulsion a corrosion-inhibition-effective amount of at least one compound of the formula

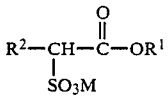

wherein:

$R^1$ is a linear or branched $C_{8-36}$ alkyl, $C_{8-36}$ alkenyl, or a $C_{8-18}$ alkyl ethoxylated with about 1 to 10 moles of ethylene oxide;

$R^2$ is a linear or branched $C_{10-20}$ alkyl; and

M is a half equivalent of magnesium, calcium, barium, or zinc.

2. The method of claim 1 wherein said compound is present in about 0.05 to 10.0% by weight, based upon the weight of the oil to be treated.

3. The method of claim 1 wherein said compound is present in about 0.5 to 5.0% by weight, based upon the weight of the oil to be treated.

4. The method of claim 1 wherein said oil or oil-containing emulsion is a lubricating oil, lubricating grease, transmission oil, or mineral oil based machine oil.

5. The method of claim 1 wherein $R^1$ is at least one linear $C_{8-22}$ alkyl.

6. The method of claim 5 wherein $R^1$ is a mixture of several of said alkyls.

7. The method of claim 1 wherein $R^1$ is a mixture of several of said alkyls.

8. The method of claim 1 wherein $R^1$ is a mixture of $C_{12-18}$ alkyls.

9. The method of claim 1 wherein $R^1$ is a mixture of cetyl and oleyl.

10. The method of claim 1 wherein $R^1$ is at least one branched alkyl of a Guerbet alcohol.

11. The method of claim 1 wherein $R^1$ is at least one $C_{12-18}$ alkyl ethoxylate with about 3 to 6 moles of ethylene oxide.

12. The method of claim 1 wherein $R^2$ is an even-numbered linear $C_{10-16}$ alkyl.

13. The method of claim 5 wherein $R^2$ is an even-numbered linear $C_{10-16}$ alkyl.

14. The method of claim 6 wherein $R^2$ is an even-numbered linear $C_{10-16}$ alkyl.

15. The method of claim 7 wherein $R^2$ is an even-numbered linear $C_{10-16}$ alkyl.

16. The method of claim 8 wherein $R^2$ is an even-numbered linear $C_{10-16}$ alkyl.

17. The method of claim 9 wherein $R^2$ is an even-numbered linear $C_{10-16}$ alkyl.

18. The method of claim 10 wherein $R^2$ is an even-numbered linear $C_{10-16}$ alkyl.

19. The method of claim 11 wherein $R^2$ is an even-numbered linear $C_{10-16}$ alkyl.

20. The method of claim 3 wherein $R^1$ is a mixture of cetyl and oleyl and $R^2$ is an even-numbered linear $C_{10-16}$ alkyl.

* * * * *